United States Patent [19]

Stange

[11] 4,096,826

[45] Jun. 27, 1978

[54] MAGNETIC BRUSH DEVELOPMENT SYSTEM FOR FLEXIBLE PHOTORECEPTORS

[75] Inventor: Klaus K. Stange, Pittsford, N.Y.

[73] Assignee: Xerox Corporation, Stamford, Conn.

[21] Appl. No.: 688,814

[22] Filed: May 21, 1976

[51] Int. Cl.[2] ..... G03G 15/08

[52] U.S. Cl. ..... 118/656; 118/62; 355/300

[58] Field of Search ..... 118/637, 62, 644, 653, 118/654, 656, 657, 658; 355/3 DD; 427/18

[56] References Cited

U.S. PATENT DOCUMENTS

| | | | |
|---|---|---|---|
| 3,357,399 | 12/1967 | Fisher | 118/637 |
| 3,461,843 | 8/1969 | Noon | 118/637 |
| 3,664,857 | 5/1972 | Miller | 118/637 |
| 3,854,974 | 12/1974 | Sato et al. | 118/637 |
| 3,929,097 | 12/1975 | Kanda et al. | 118/62 |

*Primary Examiner*—Henry S. Jaudon
*Attorney, Agent, or Firm*—J. J. Ralabate; P. P. Eichler

[57] ABSTRACT

Disclosed is an improved magnetic brush development system for flexible photoreceptors which includes a magnetic brush development assembly positioned at a location remote from the latent image-bearing surface of the flexible photoreceptor and deflection means positioned adjacent to the non-imaging surface of the photoreceptor. Upon advancement of the latent image into a development zone defined by the magnetic brush development assembly and the deflection means, the machine logic activates the deflection means and thereby results in engagement of the magnetic brush assembly and the portion of the flexible photoreceptor bearing the latent image. The deflection means is preferably provided with a plurality of apertures at the interface of the deflection means and the flexible photoreceptor. As a pulsating air stream is fed into the deflection means and out through these apertures, an air cushion is provided for the photoreceptor and such pulsating air flow causes vibration of the photoreceptor which in turn creates a powder cloud of developer materials over the latent image.

5 Claims, 1 Drawing Figure

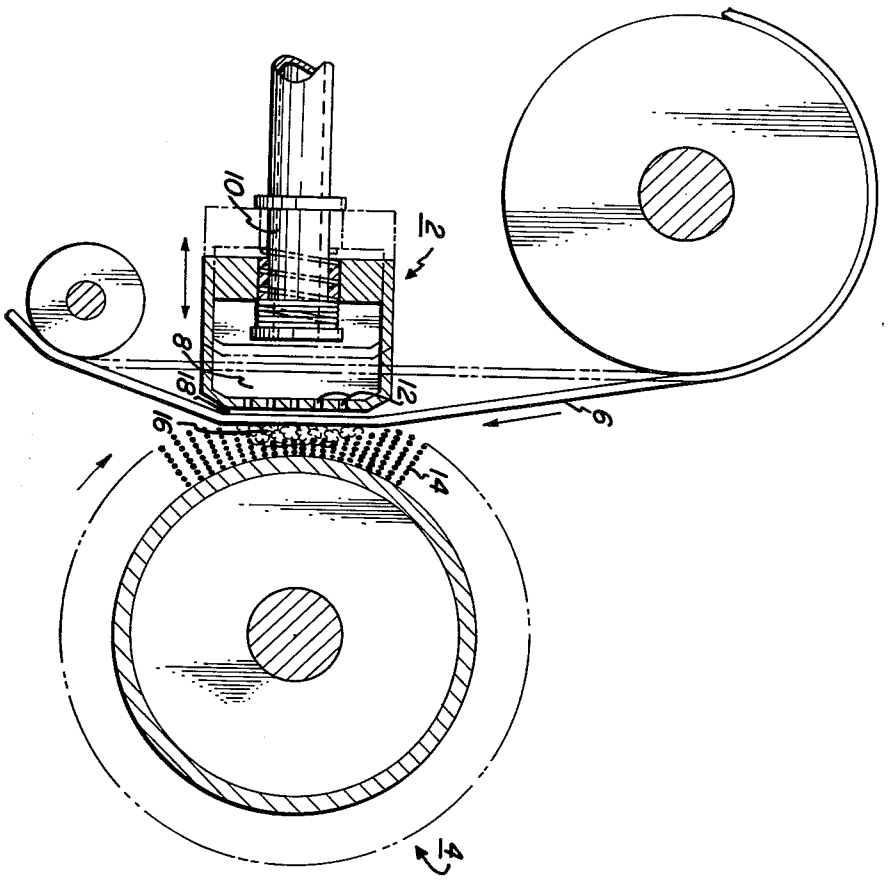
2
4
6
8
10
12
14
16
18

MAGNETIC BRUSH DEVELOPMENT SYSTEM FOR FLEXIBLE PHOTORECEPTORS

BACKGROUND OF THE INVENTION

1. Field of the Invention

This invention relates to apparatus and a method for development of a latent electrostatic image with dry developer materials. More specifically, this invention is concerned with an improved magnetic brush development system, electrostatographic apparatus employing this system and improved methods for development of latent electrostatic images with dry toner materials.

2. Background of the Invention

The formation and development of images on the imaging surfaces of photoconductive layers by electrostatic means is well known. The best known of the commercial processes, more commonly known as xerography, involves forming a latent electrostatic image on the imaging surface of an imaging member by first uniformly electrostatically charging the surface of the imaging layer in the dark and then exposing this electrostatically charged surface to a light and shadow image. The light-struck areas of the imaging layer are thus rendered relatively conductive and the electrostatic charge selectively dissipated in these irradiated areas. After the photoconductor is exposed, the latent electrostatic image on this image-bearing surface is rendered visible by development with a finely divided colored marking material, known in the art as "toner". This toner will be principally attracted to those areas on the image-bearing surface having a polarity of charge opposite to the polarity of charge on the toner particles.

The methods for development of latent electrostatic images with colored marking materials are many and varied. The revised edition of "ELECTROPHOTOGRAPHY" by R. M. Schaffert provides an excellent review of the various techniques which have been described in both technical and patent literature in Chapter 2.5 under the heading Image Development, "ELECTROPHOTOGRAPHY", R. M. Schaffert, Second Edition, John Wiley & Sons, New York City (1975). The most common method for development of latent electrostatic images in xerographic copiers involve the cascading of a two-component developer over the surface of the photoconductive member on which the image has been formed. Due to the field configurations of the electrostatic image on xerographic plate, large solid areas of the image are not developed as intensely as the edges of these solid areas. One method for minimizing such "edge effects" is the use of cascade development in combination with a device known as "a development electrode". As the need arose for designing more compact machines, magnetic brush development became increasingly popular. The pioneering work in this type of development system was performed at RCA and the earlier patents describing such a system issued in the late 1950's; these patents being U.S. Pat. Nos. 2,786,439; 2,786,440 and 2,786,441, all of which are hereby incorporated by reference in their entirety. These magnetic brush development systems consisted essentially of a magnet with a mass of iron filings or ferromagnetic powder attached thereto by magnetic attraction. The chain-like arrangement of magnetic particles simulate the fibers of a brush. When powdered toner is applied to the brush, the toner particles cling to the ferromagnetic fibers by triboelectric attraction. These ferromagnetic fibers acquire a charge of one polarity and the toner acquires a polarity of the opposite polarity. This technique has been found to be superior to cascade development in that it enables better solid density development and reduced mechanical attrition of the materials of the developer package. The magnetic brush development systems are not, however, without their disadvantages. As toner materials are depleted from the "fibers" of the magnetic brush during development, these same brush fibers will tend to pick off toner particles from those areas of the image which have been previously developed. This scavenging action of the "fibers" tends to reduce the density of the developed image unless compensating measures are taken; such as overloading the magnetic brush with toner or increasing the development zone.

A third well-known technique for development of electrostatic images is powder cloud development. In powder cloud development systems, an extremely fine powder is blown through small diameter tubes thereby breaking up toner agglomerates and providing at the same time a charge to the particles of toner by frictional contact of the particles against one another and the sides of the metal tubes. The cloud of toner is then entrained between a development electrode and the photoconductive member on which has been formed a latent electrostatic image. The developer materials from the powder cloud are deposited upon the xerographic plate in proportion to the charge densities represented in the electrostatic image. This technique provides a highly acceptable method for forming continuous tone reproductions and has been adapted for use in xeroradiography. As one might expect, this system does have its detractors in that the aerosol of toner which is used for development of the latent electrostatic image can create problems within the copying system because of difficulties inherent in the control of the flow of this aerosol. One system which has been described in the patent literature proports to combine the advantages of powder cloud development with the simplicity of cascade development, see U.S. Pat. No. 3,357,339. The '339 patent discloses a fluidized bed development system which is supplied with developer materials from a cascade conveyor assembly. The fluidized bed modification of the cascade assembly operates similar in principle to the powder cloud development system discussed previously insofar as the fluidized bed assembly creates an aerosol of developer materials in the region of the latent electrostatic image. These toner particles are attracted to the latent electrostatic image and adhere thereto in a fashion similar to that described with respect to powder cloud development. The developer system containing this fluidized bed modification is at least as bulky as the cascade development systems described earlier, and for this reason are not practical for use in copying equipment where the constraints upon machine size require a more compact developer unit.

Accordingly, it is the object of this invention to remove the above as well as related deficiencies in the prior art.

More specifically, it is the primary object of this invention to provide an improved development system which offers the advantages of compactness of magnetic brush development and yet is free from the deficiencies in magnetic brush development.

It is another object of this invention to provide an electrophotographic copying system employing the improved magnetic development system referred hereinabove.

It is still yet another object of this invention to provide a method for developing latent electrostatic images with the improved magnetic brush development system referred to hereinabove.

SUMMARY OF THE INVENTION

The above and related objects are achieved by providing an improved magnetic brush development system for developing latent electrostatic images on flexible members. This system comprises a magnetic brush assembly which is positioned at a location remote from the latent image-bearing surface of the flexible image-bearing member. This system also includes a deflection means which is positioned adjacent to the non image-bearing surface of the flexible image-bearing member. This deflection means is provided with an air-cushion chamber adjacent to the non-imaging surface of the flexible image-bearing member. The wall of the air-cushion chamber adjacent to the non-imaging of the flexible member is provided with a plurality of apertures. The deflection means is also provided with an actuator assembly which, upon receipt of an appropriate signal from the machine logic, causes advancement of the air-cushion chamber imposing an air cushion against the non image-bearing surface of the flexible image-bearing member and thereby the engagement of the developer assembly and the latent image-bearing surface of the flexible member. Concurrent with the activation of the actuator assembly, a pulsating air stream is introduced into the air-cushion chamber of the deflection means, thereby causing vibration of the flexible member at the point of its engagement with the magnetic brush development assembly. This vibration of the flexible member creates a powder cloud of developer materials at the development zone.

BRIEF DESCRIPTION OF THE DRAWING

FIG. 1 is a schematic of the improved magnetic brush development system of this invention.

FIG. 2 is an enlarged view of the improved magnetic brush development system of this invention.

DESCRIPTION OF THE INVENTION INCLUDING PREFERRED EMBODIMENTS

In FIG. 1 is shown a perspective view in vertical cross-section through a preferred embodiment of the magnetic brush development system of this invention. In the device which is shown in FIG. 1, actuator assembly 10 of deflection means 2 has been activated in coordination with the movement of a latent electrostatic image on image-bearing member 6 through the development zone defined by magnetic brush assembly 4 and the deflection means 2. Such activation has resulted in the engagement of the image-bearing surface of flexible member 6 and the magnetic fibers 14 of the magnetic brush development assembly. Concurrent with the activation of the deflection means, a pulsating air stream is introduced into air-cushion chamber 8 whereupon an air cushion 18 is provided between aperture plate 12 of the air-cushion chamber and the non image-bearing surface of flexible image-bearing member 6. As pulsating air streams through the apertures in the aperture plate, the flexible member is caused to vibrate in the development zone thereby resulting in the creation of a powder cloud 16 of developer materials over the latent electrostatic image. Upon completion of development of the latent electrostatic image, actuator assembly 10 is inactivated by the machine logic (not shown) thereby resulting in retraction of the deflection means and thus the disengagement of the image bearing flexible member 6 from the magnetic brush developer assembly. Concurrent with inactivation of the actuator assembly of the deflection means, the air supply (not shown) to the air-cushion chamber is cut off. In the event that the deflection means, when retracted, is still in contact with the non-imaging surface of flexible member 6, it may be advisable to continue to provide an air cushion between the non-imaging surface of said flexible member and the deflection means in order to reduce drag on the flexible member.

It is both critical and essential for operation of the improved magnetic brush development system of this invention that the latent image-bearing member be maintained under constant tension and yet possess sufficient freedom of movement so as to permit engagement and disengagement with the magnetic brush development assembly by the deflection means. The requisite freedom of movement of the photoreceptor can be maintained through the use of the type of pneumatic chambers disclosed in U.S. Pat. No. 3,807,854 which is hereby incorporated by reference in its entirety. In this patent, a flexible photoreceptor is threaded through the copying device in such a fashion as to permit reciprocation of the photoreceptor by a pair of pneumatic chambers arranged in tandem with one another; one being located in advance of the various processing stations of the copying apparatus and the other being located following the processing stations of the electrophotographic apparatus. These pneumatic chambers provide the requisite photoreceptor tension and yet will permit deflection of the photoreceptor in the manner required by the instant invention.

As will be appreciated by one skilled in the art, this improved magnetic brush development system can be used in either a monochrome or polychrome reproduction system. In a typical polychrome reproduction system, a plurality of these assemblies will be present, each having a different colored developer material. Various other modifications of the invention described above will become apparent to one conversant in this technology. For example, the actuator assembly can be a solenoid or a pneumatic device or be activated mechanically. In addition, the geometry of the aperture plate of the air-cushion chamber need not be flat but can assume a convex shape. As will be appreciated, the flexible member bearing the latent electrostatic image can be a photoconductor or an insulating surface upon which a latent electrostatic image has been created or transferred.

The specific embodiments of this invention described hereinabove are merely intended to be illustrative of the subject matter of this invention and in no way are intended to define the scope of this invention which is set forth in the claims which follow.

What is claimed is:

1. An improved magnetic brush development system for developing a latent electrostatic image on a flexible member, comprising:

(a) a development zone defined by (i) a magnetic brush development assembly positioned apart from the latent image-bearing surface of the flexible member; and (ii) deflection means positioned adjacent to the non-image-bearing side of the flexible member, said deflection means being provided with an air-cushion chamber, one wall of which comprises a plate having a plurality of apertures to permit formation of an air cushion at the interface of said chamber and the non-image-bearing side of the flexible member and an actuator assembly, which upon receipt of an appropriate signal from a machine logic, advances the air-cushion chamber and air cushion against the non-image-bearing side of the flexible member to permit feedable engagement of the developer assembly and a latent image-bearing side of the flexible member;

(b) means for coordinating the activation of the activator assembly and moving the flexible image-bearing member; and (c) means for supplying a pulsating air stream to the air-cushion chamber of the deflection means concurrent with the activation of the actuator assembly whereby a powder cloud of developer materials is created within the development zone concurrent with the passage through said zone of a latent image-bearing surface of the flexible member.

2. The system of claim 1, wherein the flexible member is in the form of an endless belt.

3. The system of claim 1, wherein the flexible member is a scroll.

4. The system of claim 1, wherein the actuator assembly comprises a solenoid.

5. The system of claim 1, wherein the flexible member is a photoconductor.

* * * * *